US006520788B2

(12) United States Patent
Ichida et al.

(10) Patent No.: US 6,520,788 B2
(45) Date of Patent: Feb. 18, 2003

(54) WATERTIGHT CONNECTOR AND SEALING MEMBER

(75) Inventors: Kiyofumi Ichida, Yokkaichi (JP); Hitoshi Okumura, Yokkaichi (JP); Nobuyoshi Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/813,710

(22) Filed: Mar. 21, 2001

(65) Prior Publication Data

US 2001/0026049 A1 Oct. 4, 2001

(30) Foreign Application Priority Data

Mar. 21, 2000 (JP) ..... 2000-078019

(51) Int. Cl.[7] ..... H01R 13/52
(52) U.S. Cl. ..... 439/271; 439/587
(58) Field of Search ..... 439/271, 587, 439/272, 273, 589

(56) References Cited

U.S. PATENT DOCUMENTS 5,458,508 A 10/1995 Sawada
6,000,974 A 12/1999 Hotea
6,039,592 A * 3/2000 Shinchi ..... 439/271
6,135,802 A 10/2000 Nakamura
6,368,131 B1 * 4/2002 Takeuchi et al. ..... 439/271

FOREIGN PATENT DOCUMENTS

| | | |
|---|---|---|
| EP | 0 065 066 | 11/1982 |
| EP | 0 52 074 | 1/1990 |
| JP | 9-134756 | 5/1997 |

* cited by examiner

*Primary Examiner*—Tho D. Ta
(74) *Attorney, Agent, or Firm*—Anthony J. Casella; Gerald E. Hespos

(57) ABSTRACT

A watertight connector includes male and female housings (10, 20). The male housing (10) has an engaging end surface (10A) with a mounting recess (15) in which a seal (40) is mountable. The seal (40) has sealing portions (45) to be fitted around outer surfaces of pillars (16) that surround male terminal fittings (13). A lattice-shaped array of press-in grooves (46) is provided between the sealing portions (45), and a peripheral press-in groove (47) is formed between the sealing portions (45) and the mounting recess (15). A peripheral rib (32) and a lattice-shaped array of ribs (33) project from an engaging end surface (20A) of the female housing (20). The ribs (32, 33) enter the press-in grooves (46, 47) as the housings (10, 20) are connected and come into sealing contact with the outer circumferential surfaces of the sealing portions (45).

5 Claims, 7 Drawing Sheets

WATERTIGHT CONNECTOR AND SEALING MEMBER

BACKGROUND OF THE INVENTION

1. Field of the Invention

The present invention relates to a watertight connector and to a sealing member for the connector.

2. Description of the Related Art

A known watertight connector is disclosed in Japanese Unexamined Patent Publication No. 7-134756. The connector includes male and female housings. The male housing has opposite front and rear ends and a receptacle that is open into the front end. The female housing has a terminal-accommodating portion with a plurality of cavities. The terminal-accommodating portion of the female housing is dimensioned to fit into the receptacle of the male housing. A sealing member is mounted on the outer circumferential surface of the terminal-accommodating portion and is held in sealing contact with the inner circumferential surface of the receptacle to provide a watertight fit between the two housings when the housings are connect ed with each other.

The sealing member of the above-described connector is between the receptacle, at the outer side, and the terminal-accommodating portion, at the inner side. Accordingly, size reduction options for the connector are limited because the connector is made radially larger by the thickness of the sealing member.

The present invention was developed in view of the above problem, and an object of the invention is to reduce the size of a connector and to provide a watertight fit between male and female housings.

SUMMARY OF THE INVENTION

The invention is directed to a watertight connector that comprises first and second connector housings that can be connected with each other. A seal is provided on an engaging end surface of the first connector housing, and at least one rib projects from or near an engaging end surface of the second connector housing. The seal can be brought into sealing contact with the rib as the connector housings are connected. As a result, a watertight fit is provided between the connector housings.

The seal is accommodated within an area of the engaging end surface of the second connector housing. Thus, the thickness of the seal leads to no radial enlargement of the connector, and as a result, radial dimensions of the connector can be reduced.

A mounting recess may be formed in the engaging end surface of the first or male connector housing for receiving the seal. The mounting recess enables the seal to be mounted in a position that is retracted from the engaging end surface of the first or male connector housing. Therefore, the size of the connector also can be reduced in the connecting direction of the connector housings.

Cavities may be provided in the second connector housing, and a peripheral rib may surround the cavities. Additionally, partitioning ribs may be formed on the engaging end surface of the second connector housing for partitioning the respective cavities. The partitioning rib may be continuous with the peripheral rib and may be pressed into a press-in groove in the sealing member as the connector housings are connected.

According to a further preferred embodiment, cavities are provided in the female connector housing, and a peripheral rib in the form of a frame surrounds the cavities. Additionally, partitioning ribs partition the respective cavities. The partitioning ribs are formed on the engaging end surface of the female connector housing and are continuous with the peripheral rib. Additionally, the partitioning ribs can be pressed into a press-in groove formed in the sealing member as the connector housings are connected.

A watertight fit can be provided between the connector housings as well as between adjacent cavities by holding the peripheral rib and the partitioning ribs in sealing contact with the seal. Portions of the seal, including the press-in groove, are arranged inside the partitioning ribs for partitioning the cavities. Thus, the thickness of these portions leads to no radial enlargement of the connector, and as a result radial dimensions of the connector can be reduced further.

The seal preferably comprises at least one elongated lip on each sealing portion thereof. The elongated lips preferably extend substantially along a mating direction of the connector housings.

The invention also is directed to a seal for use with a watertight connector. The seal is to be mounted on an engaging end surface of a first connector housing of the watertight connector. The seal comprises an outer circumferential portion for contact with an engaging end surface of a second connector housing that can be connected with the first connector housing. At least one sealing portion may be fit around the outer surfaces of one or more pillars that surround the respective terminal fittings of the first connector housing. The seal may comprise at least one lattice-shaped press-in groove between the respective sealing portions. A rib of the second connector housing can be inserted into the press-in groove.

These and other objects, features and advantages of the present invention will become apparent upon reading of the following detailed description of preferred embodiments and accompanying drawings.

DETAILED DESCRIPTION OF THE PREFERRED EMBODIMENT

Figure 1:
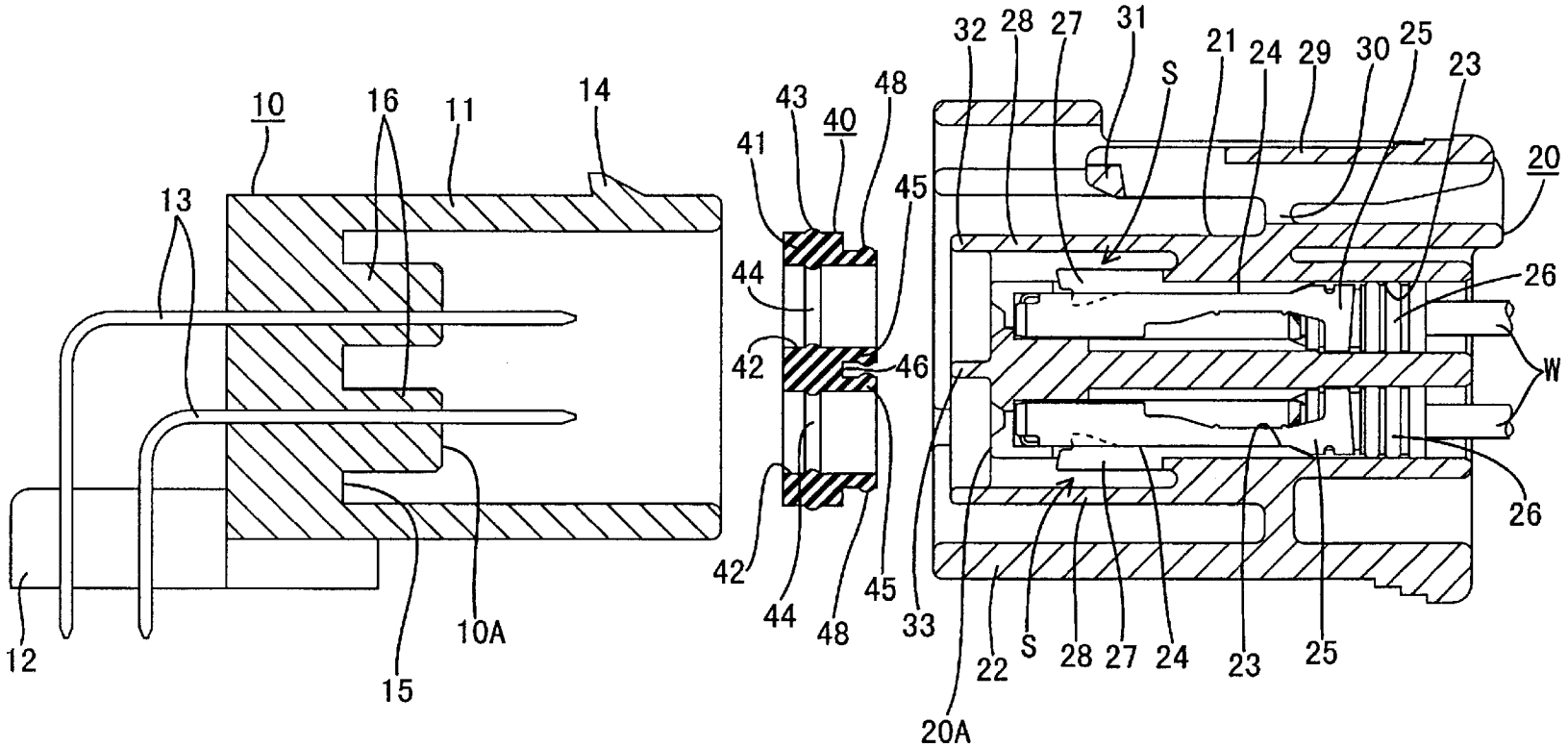
FIG. 1 is an exploded side view in section showing a connector according to one embodiment of the present invention.

A watertight connector according to the invention is shown in FIG. 1. The connector comprises a male housing 10 and a female housing 20 that are connectable with each other. The connector also comprises a seal 40 that is mounted in the male housing 10 to prevent entrance of water. In the following description, sides of the respective housings 10, 20 that are connected with one another are referred to as the respective fronts.

Figure 2:
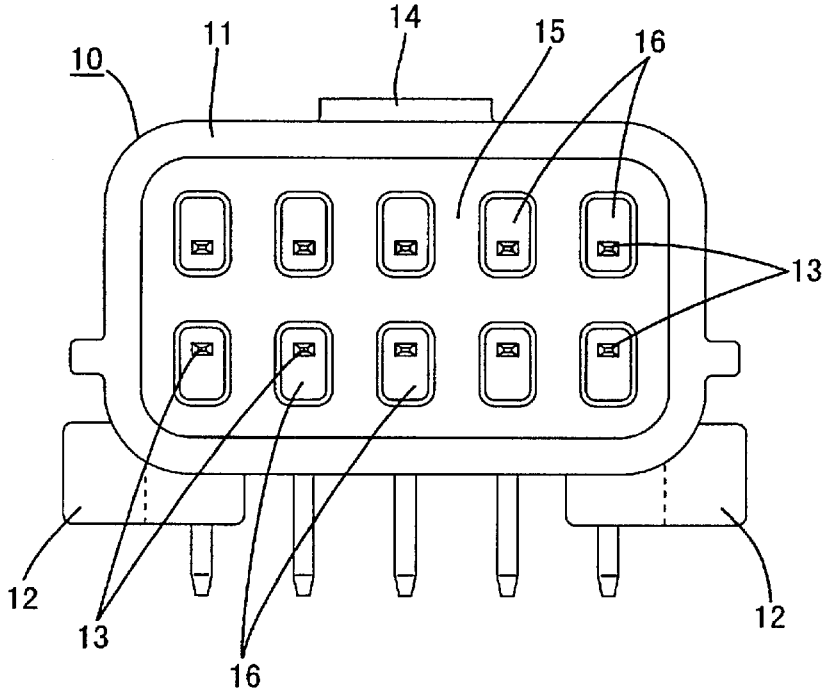
FIG. 2 is a front view of a male housing.

A forwardly opening tubular receptacle 11 is formed at the front of the male housing 10, and a mount plate 12 is provided on the lower rear of the male housing 10 for mounting on an unillustrated circuit board. As shown in FIGS. 1 and 2, male terminal fittings 13 are embedded in the male housing by insert molding, and are disposed at specified intervals in two stages. Each male terminal fitting 13 is substantially flat along its entire length, and is formed into an L-shape by bending down a portion that projects backward from the male housing 10. A locking projection 14 projects substantially in the widthwise center of the upper surface of the receptacle 11, and is configured for engagement with a lock arm 29 of the female housing 20, as explained below.

Figure 3:
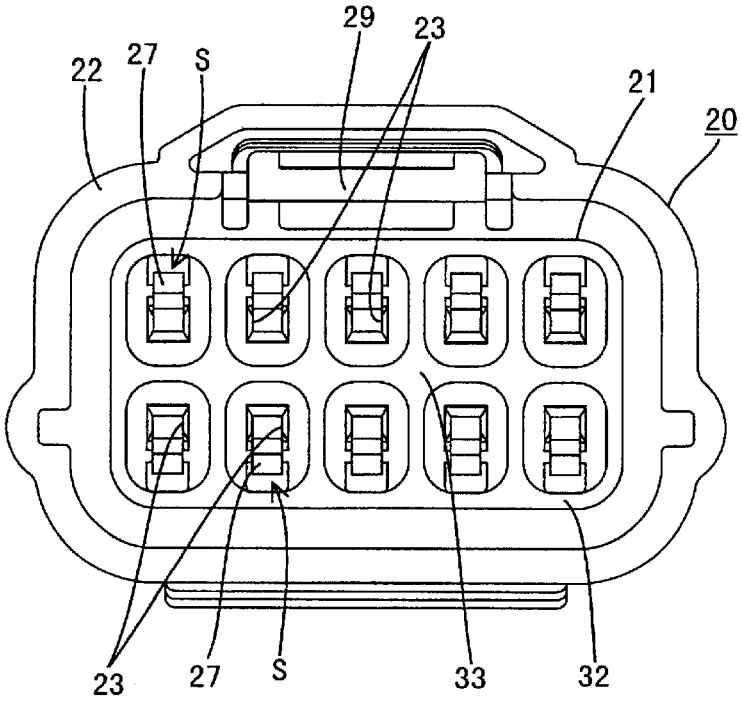
FIG. 3 is a front view of a female housing.

The female housing 20, as shown in FIGS. 1 and 3, has a terminal-accommodating portion 21 that can be fit into the receptacle 11 of the male housing 10, and an outer tubular portion 22 that can be fit around the receptacle 11. Cavities 23 are formed in the terminal-accommodating portion 21 in positions that align with the male terminal fittings 13. The cavities 23 accommodate female terminal fittings 24 that are connected with ends of wires W and that can be engaged with the mating male terminal fittings 13 when the housings 10, 20 are connected. As shown in FIG. 1, a front part of each female terminal fitting 24 is substantially box-shaped, and a barrel 25 is formed at the rear end for crimped connection with a rubber plug 26 mounted at an end of the corresponding wire W. The rubber plug 26 is in sealing contact with the inner surface of the cavity 23 and holds the inside of the cavity 23 watertight.

Locks 27 are cantilevered into the cavities 23 from the upper surfaces of the upper stage cavities 23 and from the lower surfaces of the lower stage cavities 23. Each lock 27 is elastically deformable to engage and lock a female terminal fitting 24 inserted into the cavity 23. A deformation permitting space S is provided outside each lock 27 and opens forwardly. Hence, a jig (not shown) can be inserted into the deformation permitting space S from the front to deform the lock 27 sufficiently to withdraw the female terminal fitting 24. A wall 28 is provided outside the deformation permitting space S.

Figure 8:
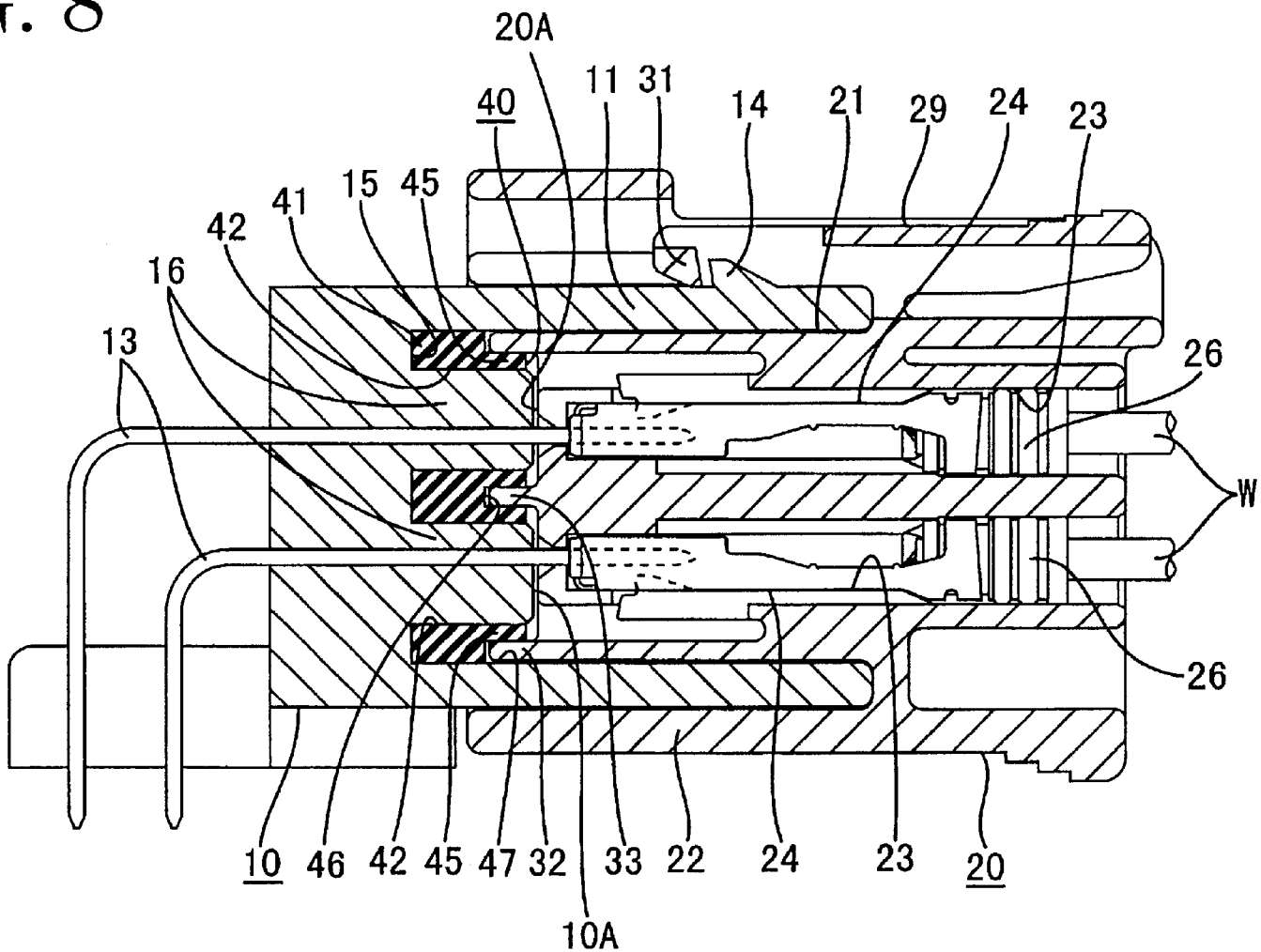
FIG. 8 is a side view in section showing the properly connected housings.

A seesaw-shaped lock arm 29 is provided substantially in the widthwise center of the upper surface of the terminal accommodating portion 21, as shown in FIGS. 1 and 3. The lock arm 29 can pivot elastically upward and downward about a supporting portion 30. The lock arm 29 has a front end with a lock portion 31, and the housings 10, 20 can be locked into each other by engaging the lock portion 31 with the locking projection 14 of the male housing 10, as shown in FIG. 8.

A mounting recess 15 is formed in an engaging end surface 10A of the male housing 10, as shown in FIGS. 1 and 2, for mounting the sealing member 40. Pillars 16 project from the mounting recess 15 and surround the respective male terminal fittings 13. Front-facing surfaces of the pillars 16 define the engaging e nd surface 11A of the male housing 10. A peripheral rib 32 and an array of partitioning ribs 33 project from an engaging end surface 20A of the female housing 20, as shown in FIG. 1, and can be brought into sealing contact with the seal 40.

Figure 4:
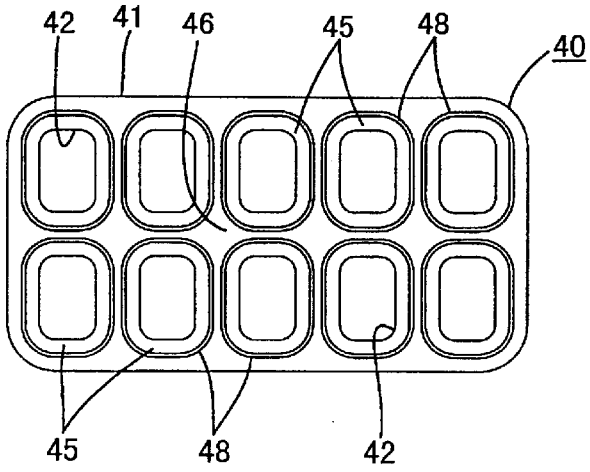
FIG. 4 is a front view of a sealing member.
Figure 5:
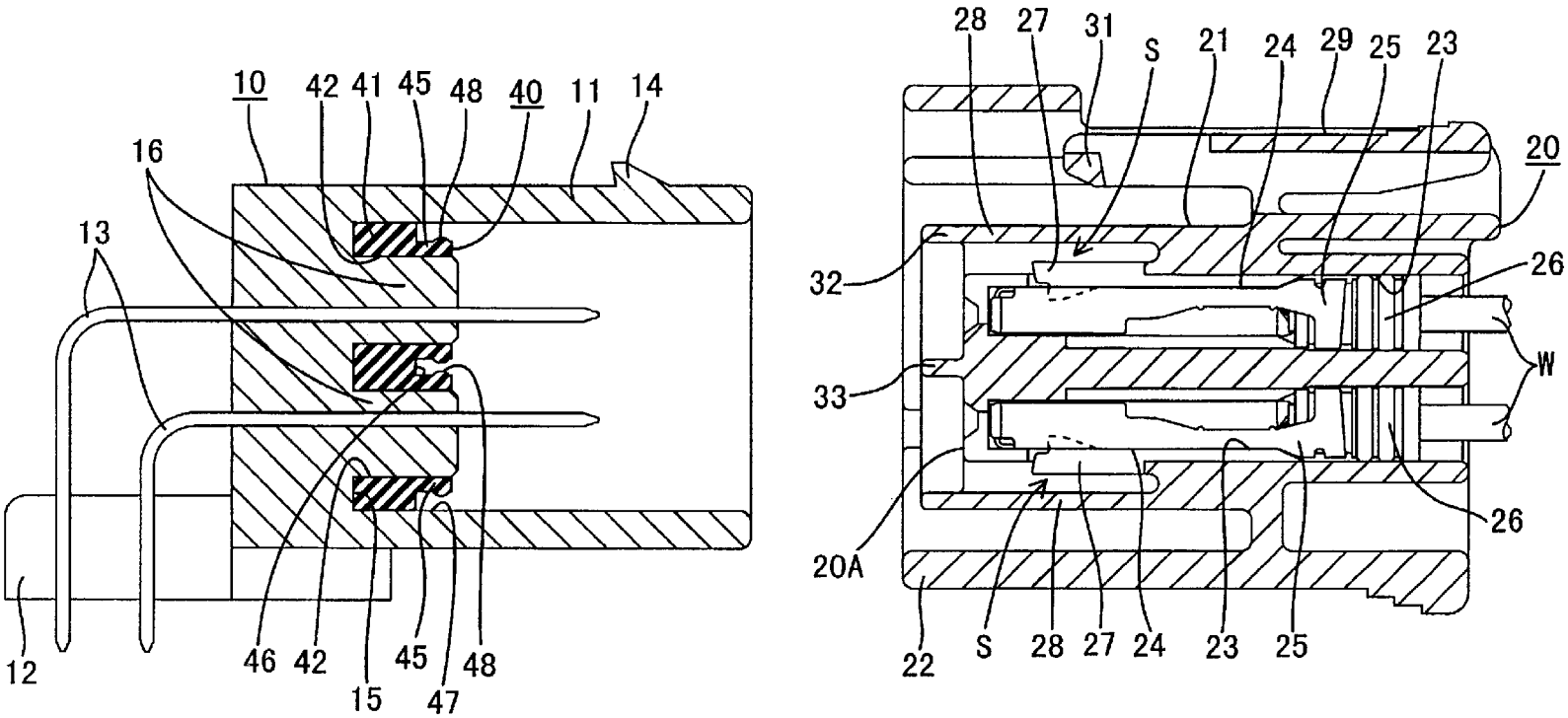
FIG. 5 is a side view in section showing the male housing having the sealing member mounted therein and the female housing.

The seal 40 has a mount portion 41 that can be inserted up to the bottom end of the mounting recess 15 for mounting the seal 40 in the male housing 10. As shown in FIGS. 1 and 4, the mount portion 41 is substantially plate-shaped and is formed with through holes 42 in positions that correspond to the respective pillars 16. An outer circumferential lip 43 is formed around the outer circumferential surface of the mount portion 41 and inner circumferential lips 44 are formed around the inner circumferential surfaces of each respective through holes 42. As shown in FIG. 5, the seal 40 can be mounted in the mounting recess 15 such that the outer lip 43 of the mount portion 41 is held in sealing contact with the inner wall surface of the mounting recess 15. Additionally, the inner lips 44 of the respective through holes 42 are held in sealing contact with the outer circumferential surfaces of the pillars 16 while being deformed. In this way, the sealing ability of the seal 40 is improved, and it is difficult for the seal 40 to come out of the male housing 10.

Figure 6:
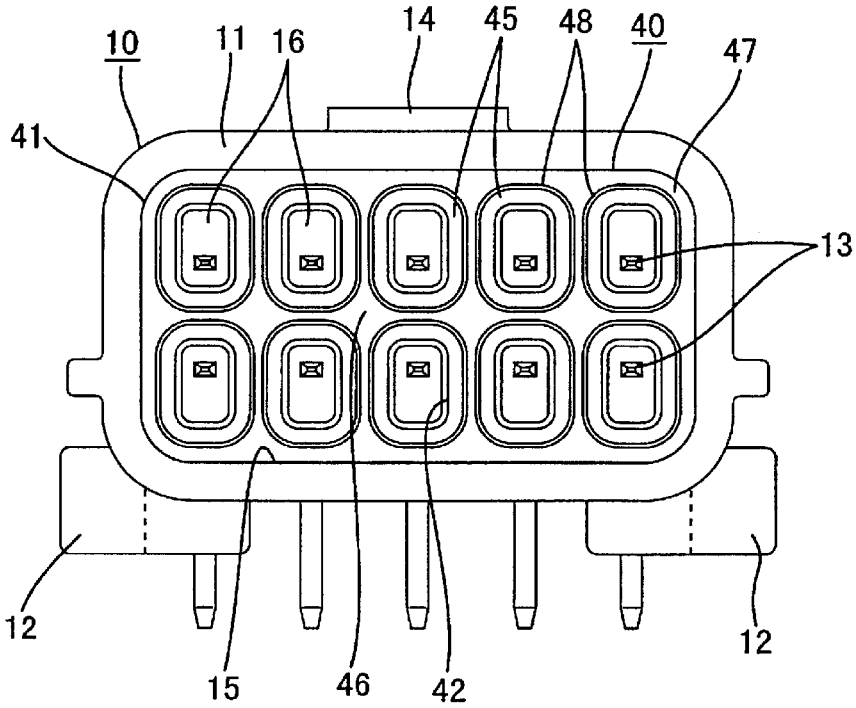
FIG. 6 is a front view showing the male housing having the sealing member mounted therein.

Rectangular tubular sealing portions 45 project forward from the front surface of the mount portion 41 and surround the respective through holes 42, as shown in FIGS. 1 and 4. The inner circumferential surfaces of the sealing portions 45 are continuous with the through holes 42 of the mount portion 41, and can be held in sealing contact with the outer circumferential surfaces of the pillars 16, as shown in FIGS. 5 and 6. Specified clearances are provided between adjacent sealing portions 45, as shown in FIG. 6, thereby forming a lattice-shaped array of press-in grooves 46 into which the partitioning ribs 33 of the female housing 20 can be inserted. The respective sealing portions 45 are located inside the outer periphery of the mount portion 41. A rectangular frame-shaped peripheral press-in groove 47 is defined between the outer circumferential surfaces of the sealing portions 45 that do not form the press-in groove 46 and the inner circumferential surface of the mounting recess 15. The peripheral rib 32 of the female housing 20 can be pressed into the press-in groove 47.

The rectangular frame-shaped peripheral rib 32 projects forward from the outer periphery of the engaging end surface 20A of the female housing 20, as shown in FIGS. 3 and 5. The peripheral rib 32 is substantially continuous with the wall 28 of the terminal accommodating portion 21, and substantially surrounds all the cavities 23. The lattice-shaped array of partitioning ribs 33 is substantially continuous with peripheral the rib 32 at locations inside the peripheral rib 32 and between the cavities 23. Thus, the partitioning ribs 33 individually partition the respective cavities 23. The ribs 32, 33 are formed such that their front ends are substantially aligned.

The ribs 32, 33 are pressed into the press-in grooves 46, 47 of the male housing 10 as the housings 10, 20 are connected. Thus, the ribs 32, 33 come into sealing contact with the outer circumferential surfaces of the sealing portions 45 of the seal 40, as shown in FIG. 8. Accordingly, the ribs 32, 33 substantially prevent entrance of water from outside the housings 10, 20 and from the adjacent cavities 23. In this state, the sealing portions 45 are squeezed between the pillars 16 and the ribs 32, 33. A continuous lip 48 is formed around the outer circumferential surface of each sealing portion 45 to provide a sufficient contact pressure between the sealing portions 45 and the ribs 32, 33 and to improve the watertight sealing of the connector.

The seal 40 is mounted in the mounting recess 15 of the male housing 10, as shown in FIG. 5, and the housings 10, 20 are at least partly connected. The receptacle 11 of the male housing 10 is inserted between the outer tubular portion 22 and the terminal accommodating portion 21 of the female housing 20 during the connection process.

Figure 7:
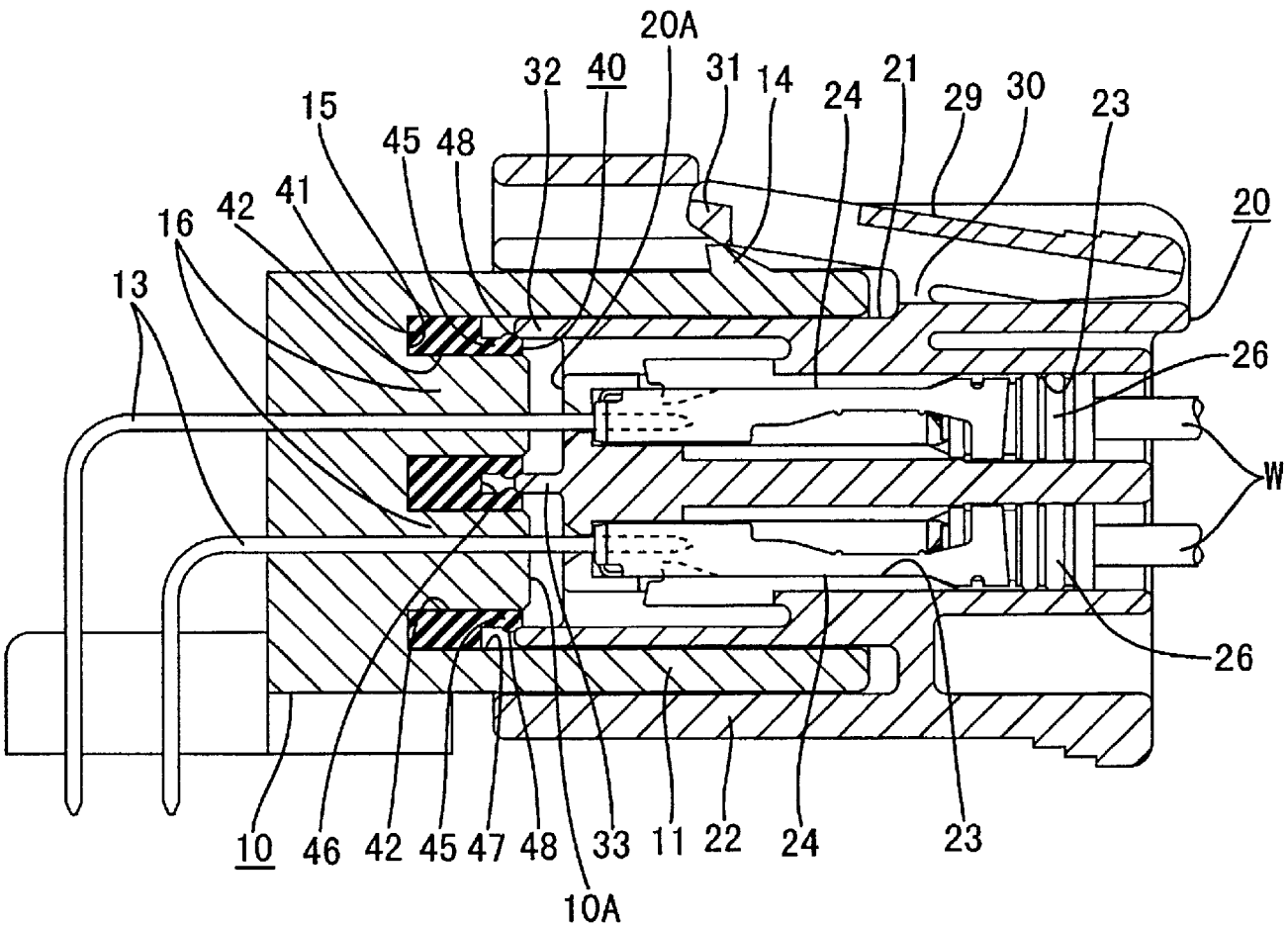
FIG. 7 is a side view in section showing an intermediate state during connection of the two housings.

As the connection progresses, the lock portion 31 moves onto the locking projection 14, thereby elastically pivoting the lock arm 29 as shown in FIG. 7. At this time, leading ends of the peripheral rib 32 and the partitioning ribs 33 are substantially at the same position as the engaging end surface 10A of the male housing 10, and enter the press-in grooves 46, 47 of the seal 40 as the connection progresses further.

The peripheral rib 32 is pressed into the frame-shaped peripheral press-in groove 47 between the sealing portions 45 and the mounting recess 15 while deforming the lips 48.

Additionally, the partitioning ribs 33 are pressed into the lattice-shaped press-in grooves 46 between the sealing portions 45 and deform the lips 48 in a similar manner to the deformation caused by the peripheral rib 32. The housings 10, 20 eventually are connected to a depth where the lock portion 31 of the lock arm 29 moves over the locking projection 14. The lock arm 29 then is restored elastically substantially to its original position and the lock portion 31 engages the locking projection 14, as shown in FIG. 8. As a result, the housings 10, 20 are properly connected and locked into each other by the lock arm 29.

At this stage, the peripheral rib 32 and the partitioning ribs 33 reach the bottoms of the press-in grooves 46, 47 and are held completely in sealing contact with the entire outer circumferential surfaces of the sealing portions 45. The sealing portions 45 of the seal 40 that surround the male terminal fittings 13 are squeezed between the pillars 16 at the inner side and the ribs 32, 33 at the outer side. Thus, water is prevented from reaching the male and female terminal fittings from the outside through clearances between the housings 10, 20. Even if water enters the cavity 23 through the wire W from the other end of the female terminal fitting 24 by capillary action, entrance of the water into the adjacent cavities 23 is prevented, thereby preventing the adjacent terminal fittings 13, 24 from being short-circuited.

As described above, the seal 40 is accommodated within an area of the engaging end surface 20A of the female housing 20 by holding the peripheral rib 32 that projects from the engaging end surface 20A of the female housing 20 in sealing contact with the outer circumferential surfaces of the sealing portions 45. Thus, the thickness of the seal 40 leads to no radial enlargement of the connector, and the radial dimensions of the connector can be reduced. Further, the sealing portions 45 are inside the partitioning ribs 33 that partition the cavities 23 by holding the partitioning ribs 33 in sealing contact with the outer circumferential surfaces of the sealing portions 45. Thus, the thickness of the sealing portions 45 leads to no radial enlargement of the connector, and the radial dimensions of the connector can be reduced further. Additionally, a watertight seal between the housings 10, 20 and a watertight seal between the cavities 23 can be provided simultaneously by a simple construction.

The seal 40 can be in a position retracted from the engaging end surface 10A of the male housing 10 by forming the mounting recess 15 in the male housing 10. Thus, the size of the connector can also be reduced in the connecting direction of the housings 10, 20.

The present invention is not limited to the above described and illustrated embodiments. For example, the following embodiments are also embraced by the technical scope of the present invention as defined in the claims. Beside the following embodiments, various changes can be made without departing the sprit of the present invention as defined in the claims.

The male terminal fittings are embedded in the male housing by insert molding in the foregoing embodiment. However, they may be inserted into cavities of the male housing formed beforehand from front and may be locked therein by metal locking portions on the male terminal fittings.

A watertight seal is provided between the cavities as well as between the housings in the foregoing embodiment. However, a construction for providing the watertight seal between the cavities may be omitted if such a watertight seal is unnecessary. Specifically, it is sufficient to mount a frame-shaped seal (seal ring) in the mounting recess of the male housing and to provide the engaging end surface of the female housing with a frame-shaped rib to be held in sealing contact with the outer circumferential surface of the seal.

The mounting recess is formed in the engaging end surface of the male housing in the foregoing embodiment. However, a seal may be provided on the engaging end surface of the male housing member without forming the mounting recess, and the male terminal fittings may penetrate through this seal.

What is claimed is:

1. A watertight connector, comprising:

a first connector housing having an engaging end surface and a second connector housing having an engaging end surface, the connector housings being connected with each other at the engaging end surfaces, the second connector housing being formed with a plurality of cavities;

a seal mounted on the engaging end surface of the first connector housing, the seal having an outer circumferential surface; and a peripheral rib and an array of partitioning ribs projecting from the engaging end surface of the second connector housing and being in sealing contact with the outer circumferential surface of the seal, the peripheral rib being in a form of a frame substantially surrounding all the cavities, the array of partitioning ribs being continuous with the peripheral rib and partitioning the respective cavities.

2. A watertight connector according to claim 1, wherein a mounting recess is formed in the engaging end surface of the first connector housing, the seal being mounted in the mounting recess.

3. A watertight connector according to claim 1, wherein the seal is formed with press-in grooves disposed for receiving the partitioning ribs as the connector housings are connected.

4. A watertight connector according to claim 1, wherein the engaging end surface of the first connector housing has pillars surrounding terminal fittings of the first connector housing, the seal comprising sealing portions surrounding and sealing the respective pillars, elongated lips being formed on the respective sealing portions, the elongated lips extending along a mating direction of the connector housings.

5. A watertight connector, comprising:

a male housing having opposite front and rear ends, a rear wall at the rear end of the male housing, a tubular wall projecting forwardly from the rear wall to the front end of the male housing and defining a mounting recess, a plurality of pillars projecting forwardly from said rear wall into said mounting recess, said pillars being spaced inwardly from said tubular wall a plurality of male terminal fittings projecting through the respective pillars and toward said front end of said male housing;

a lattice-shaped seal, said seal being sealingly engaged with inner surfaces of said tubular wall and with outer surfaces of said pillars, said seal having a front face defining a peripheral groove substantially adjacent said tubular wall and an array of inner grooves inwardly of said peripheral groove, such that said peripheral groove and said inner grooves surround said pillars; and a female housing having opposite front and rear ends and cavities extending between said ends, said cavities being substantially aligned with said pillars, female terminal fittings mounted in said cavities and being mateable with said male terminal fittings, said front end of said female housing including a peripheral rib dimensioned and disposed for sealing engagement in said peripheral groove of said seal, said front end of said female terminal fitting further comprising a lattice array of ribs dimensioned and disposed for sealing engagement in said array of inner grooves in the seal.

* * * * *